US006374655B1

(12) United States Patent
Hresc

(10) Patent No.: US 6,374,655 B1
(45) Date of Patent: Apr. 23, 2002

(54) SPRING WINDING AUTOMATIC MACHINE

(75) Inventor: Stefan Hresc, Antuna Mihanoica (HR)

(73) Assignee: Spintex AG, Altendorf (CH)

( * ) Notice: Subject to any disclaimer, the term of this patent is extended or adjusted under 35 U.S.C. 154(b) by 0 days.

(21) Appl. No.: 09/582,909

(22) PCT Filed: Jan. 8, 1999

(86) PCT No.: PCT/EP99/00071

§ 371 Date: Sep. 18, 2000

§ 102(e) Date: Sep. 18, 2000

(87) PCT Pub. No.: WO99/34943

PCT Pub. Date: Jul. 15, 1999

(30) Foreign Application Priority Data

Oct. 1, 1998 (DE) ..... 198 00 671

(51) Int. Cl.[7] ..... B21F 11/00

(52) U.S. Cl. ..... 72/129; 72/135; 72/142; 72/146

(58) Field of Search ..... 72/129, 135, 137, 72/138, 142, 420, 426, 428, 143, 144, 146; 242/615, 615.1, 615.3, 615.4

(56) References Cited

U.S. PATENT DOCUMENTS

| | | | | | |
|---|---|---|---|---|---|
| 4,192,207 | A | * | 3/1980 | Bickford et al. | 83/42 |
| 4,645,894 | A | * | 2/1987 | Bonga | 219/69 W |
| 4,669,679 | A | * | 6/1987 | Pali | 72/148 |
| 5,131,251 | A | * | 7/1992 | Jacobson | 72/140 |
| 6,045,023 | A | * | 4/2000 | Michard | 226/110 |

* cited by examiner

*Primary Examiner*—Ed Tolan
(74) *Attorney, Agent, or Firm*—Wood, Herron & Evans, LLP

(57) ABSTRACT

Spring coiling machine with a drive, a wire guide, a cutter mechanism and a coiler mechanism, in which the drive is adapted for optionally driving one or other of at least two wires sitting in the wire guide at the same time.

24 Claims, 5 Drawing Sheets

SPRING WINDING AUTOMATIC MACHINE

This application is a 35 USC 371 of PCT/EP99/00071 filed Jan. 8, 1999.

The present invention relates to a spring coiling machine and also a method for switching a spring coiling machine between at least two wires during operation. Various types of such spring coiling machine are already known. They are used for making essentially helical springs from wire.

A drawback with all known types of machine is that adapting to different wire diameters is always laborious and costly. Essential components of known spring coiling machines are designed for the diameter of the wire to be worked with, and must be replaced in order to work with wires of other diameters. This particularly applies to the drive and wire guide. It means that the machine has to be set up all over again. The entire operation takes several hours. A quick changeover of the machine, so as to be able to respond flexibly, is not possible. Also, the components which need to be replaced must be properly stored to protect them from damage and dirt. Providing storage is expensive.

Therefore the problem of the present invention is to develop a spring coiling machine of the kind stated in the introduction so that it is possible to switch to other wire diameters in a very short time; and also to provide a method of doing so.

In accordance with the invention this problem is solved by the technical teaching of the independent claims.

The spring coiling machine according to the invention has a drive that is capable of optionally driving one or other of at least two wires that are sitting in the wire guide at the same time. Both the drive and the wire guide are able to receive and handle a series of wires at the same time although only one wire at a time is actually being fed.

The need for complicated replacement of components and resetting of the machine completely disappears. The switch between at least two wires is made quickly.

The wire guide preferably comprises a guide block in which bores, or opposing grooves that are open on one side, are formed to receive the wires; these bores or grooves lead into a common chamber with an outlet opening. The point of delivery from the wire guide to the cutter and coiler remains constant, and must not be varied.

To permit adaptation to wires of markedly differing diameters, an additional adapter may be provided. This has bores of different sizes. Each of these bores has a larger diameter on the side facing towards the guide block and a reduced diameter on the side facing away from the guide block. They are preferably composed of two sections, one approximately in the form of a truncated cone and the other one approximately cylindrical. The adapter is rotatable or slidable with respect to the guide block to allow the various bores to be combined with the latter.

A common drive may be provided for all wires. This preferably consists of pairs of opposing rollers provided with a number of grooves. The number of grooves corresponds to the number of wires that may be handled. The rollers are displaceable in relation to one another in a direction parallel with their rotational axis. The distances between the grooves on the rollers [of a given pair] are different. The spaces to accommodate the wires to be conveyed, formed by the groove-openings in the opposing rollers, are adaptable to the circumference of the wire. Feeding of more than two wires, e.g. of three or four wires, is also possible. When four wires are fed, each pair of rollers delivers two wires.

The wires sit in grooves on one roller. The grooves on the rollers are arranged so that in any given position of the rollers only one groove of the first roller is in register with a groove of the second roller. Therefore only one wire is driven at any one time. When the rollers are shifted in relation to one another, other grooves are brought into register with each other; the driven wire is then the wire sitting in the pair of grooves concerned.

The radial clearance and axial distance between the rollers are preferably adjustable.

In another embodiment, the rollers do not form alignable groove-spaces to be opened and closed as required. A single wire sits in each roller pair, and is fed as required. All roller pairs are aligned with a central meeting point. Individual wires are fed as required by controlling the drive to each roller pair. Under CNC, only one roller pair is driven at any one time to feed the wire held between the rollers to the central meeting point.

With regard to the first of the embodiments mentioned, the method according to the invention provides for the second or subsequent wires to be held ready inside the guide tube as the first wire is being worked with. A description of the embodiment will now be given in relation to two wires for the sake of simplicity, as follows:

Both wires are accommodated in a guide block with a common outlet opening. After the first wire has been worked with for the desired amount of time, [it] is cut, and is retracted sufficiently to allow the second wire to be fed through the common outlet.

Preferably, only one wire is driven at a time, the drive being switched accordingly. While the wire is being retracted, other components of the machine, in particular the cutter and coiler mechanisms, can be adapted to the incoming wire. This adaptation is preferably made automatically.

Besides the guide block; the wire guide may have an adapter so that the size of the delivery opening of the wire guide can be varied to allow wires of an extremely wide range of sizes to be handled without modifications to the machine.

The subject-matter of the present invention follows not only from the subject-matter of the individual claims [considered separately], but also from the individual claims taken in combination with each other.

All details and features disclosed in the documents, including the abstract, and in particular the configurative form shown in the drawings, are claimed as essential to the invention insofar as, taken separately or in combination, they are novel in relation to the state of the art.

The invention will now be described in detail with reference to drawings illustrating ways of carrying it out. Further essential features and advantages of the invention will become apparent from the drawings and their description.

Figure 1:
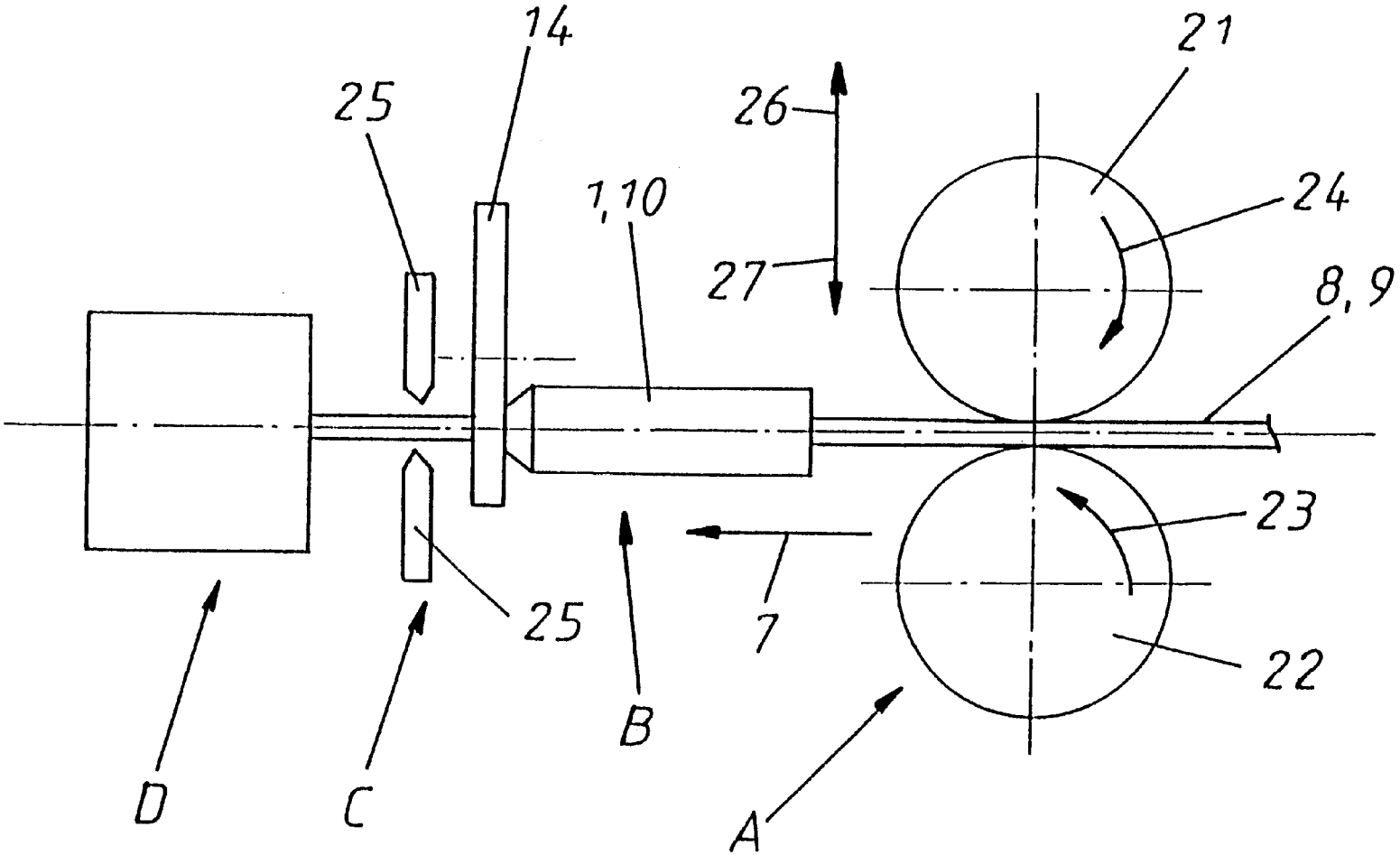
FIG. 1 is a schematic representation of a spring coiling machine.

A spring coiling machine is shown schematically in FIG. 1. The essential assemblies are drive A, wire guide B, cutter C and coiler D. Even in known spring coiling machines, the devices C and D can be adapted quickly to different wire diameters. The problem arises with the assemblies A and B.

The drive A essentially consists of two rollers 21, 22 which can be driven in the direction of arrows 23, 24 and also in the opposite direction. The gap between the rollers can be adjusted by displacing at least one of the rollers 21, 22 in the direction of arrows 26, 27. In accordance with the invention a plurality of wires 8, 9 of different diameters are guided through the gap between the rollers and fed to the wire guide B in the direction of the arrow 7.

In the illustrated embodiment the wire guide B comprises a guide block 1 or, as the case may be, 10, which is coupled with an adapter 14. The adapter 14 may be omitted. The wire guide B has to guide the wire 8, 9 with highly accurate positioning and orientation through the cutter C into the coiler D.

The cutter device C in the illustrated example has two blades 25 which are adjustable with respect to each other in the direction of arrows 26, 27. The coiler D, of which no details are shown, has a device for presetting the diameter and pitch of the spring to be coiled.

Figure 2:
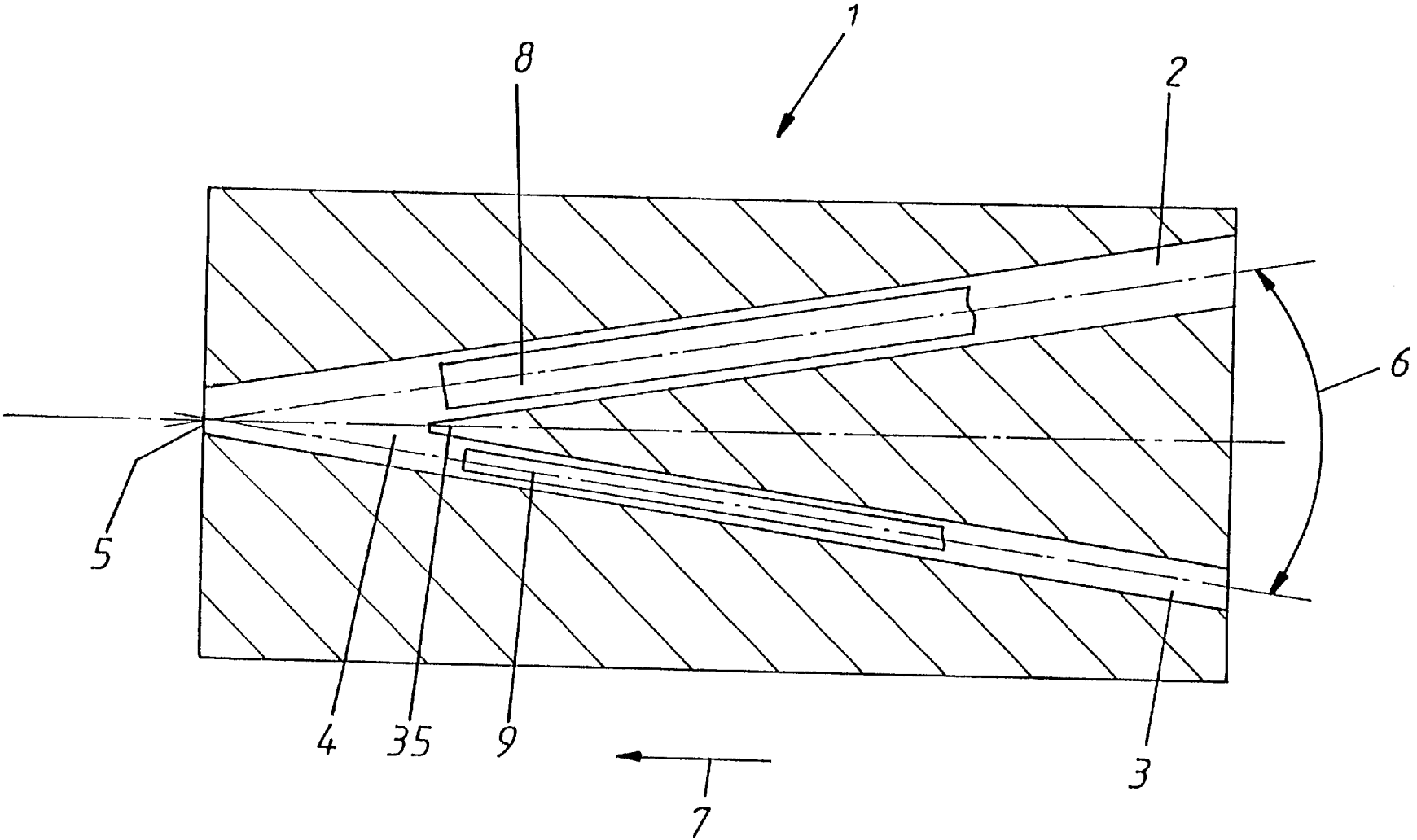
FIG. 2 shows a section through a guide block, on an enlarged scale.

FIG. 2 shows one embodiment of a guide block 1. The guide block 1 has bores or grooves 2, 3 leading into a common chamber [4] with an outlet 5. The grooves 2, 3 are set at an angle 6 to one another that is governed by the circumstances which actually prevail. A wire 8 is accommodated in the groove 2, and a wire 9 in the groove 3. It can be clearly seen that the grooves 2, 3 and the wires 8, 9 are of different sizes or diameters.

The change from wire 8 to wire 9 is accomplished as follows: First of all the wire 8 must be severed outside the guide block I by the cutter C. The wire 8 is then drawn back out of the chamber 4 sufficiently to allow the wire 9 to be fed in the direction of the arrow 7. In the short time interval required for these movements, the cutter C and the coiler D can be adapted to the incoming wire 9. The change from wire 9 to wire 8 is made in a similar fashion.

In the drawing the chamber 4 of the guide block 1 is shown greatly enlarged. The distances to be traversed are in reality very small, and the time required is a few hundredths of a second. Hence the active wire, 8 or 9 as the case may be, can be changed quickly. In practice the wire can be changed after each spring is coiled, without major losses.

Figure 3:
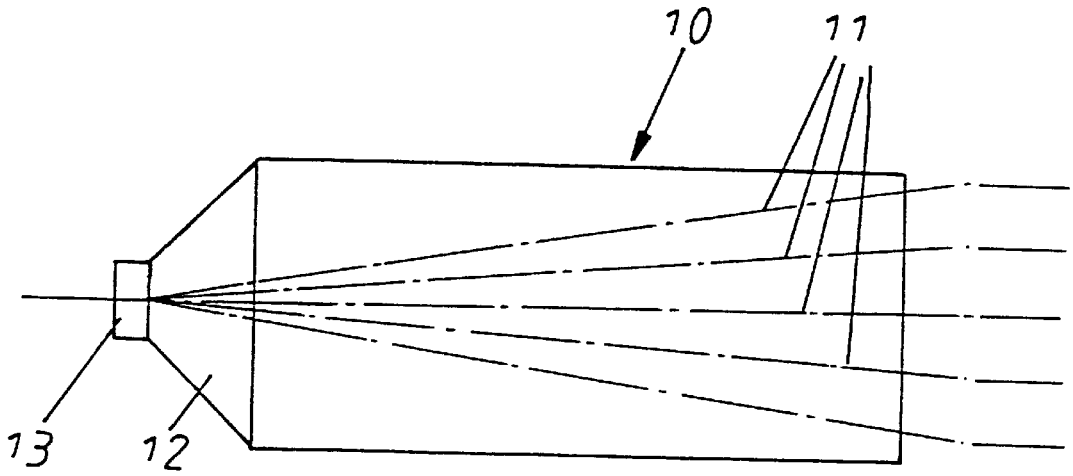
FIG. 3 is a schematic representation of another embodiment of a guide block.

FIG. 3 shows schematically another guide block 10, which is provided with five grooves 11 to receive and guide different wires. In this embodiment the guide block 10 is provided with a conical tip 12 and an extension 13. The chamber 4 preferably extends into this tip 12 and extension 13.

Figure 4:
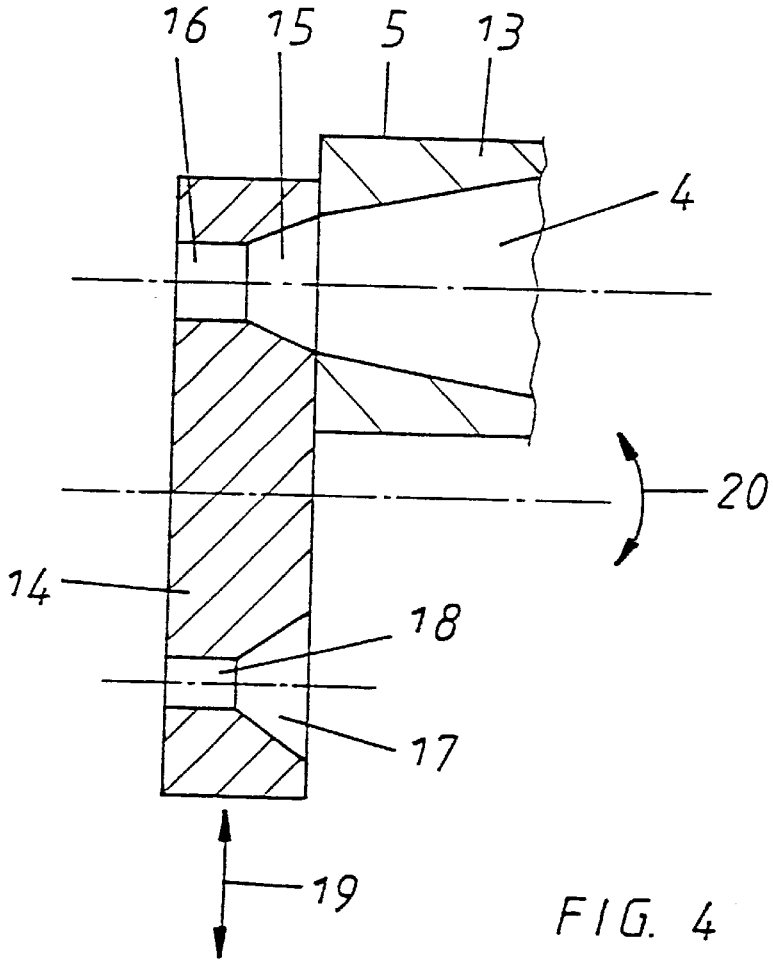
FIG. 4 shows part of the guide block of FIG. 3 together with an adapter.

The size of the outlet opening 5 determines the maximum acceptable wire diameter. At the same time, the outlet opening 5 must not be significantly larger than the wire to be worked with; otherwise accurate and reliable guidance is not assured. For working with wires of greatly differing diameters, the guide block 1 or 10 can be combined with an adapter 14, which is illustrated in FIG. 4.

This adapter 14 has a plurality of bores, each of which has two sections. A first, essentially conical, section 15 or 17 matches the outlet opening 5. This first section connects to an essentially cylindrical section 16 or 18. These sections 16, 18 have different diameters, for adaptation to different wires 8, 9.

To make the changeovers, the adapter 14 may be displaceable in the directions shown by the arrow 19. Alternatively it may be rotatable in the directions indicated by the arrow 20. Movement of the adapter 14 takes place during the retraction of the wire 8 or 9 to be changed, so that no loss of time occurs.

Figure 6:
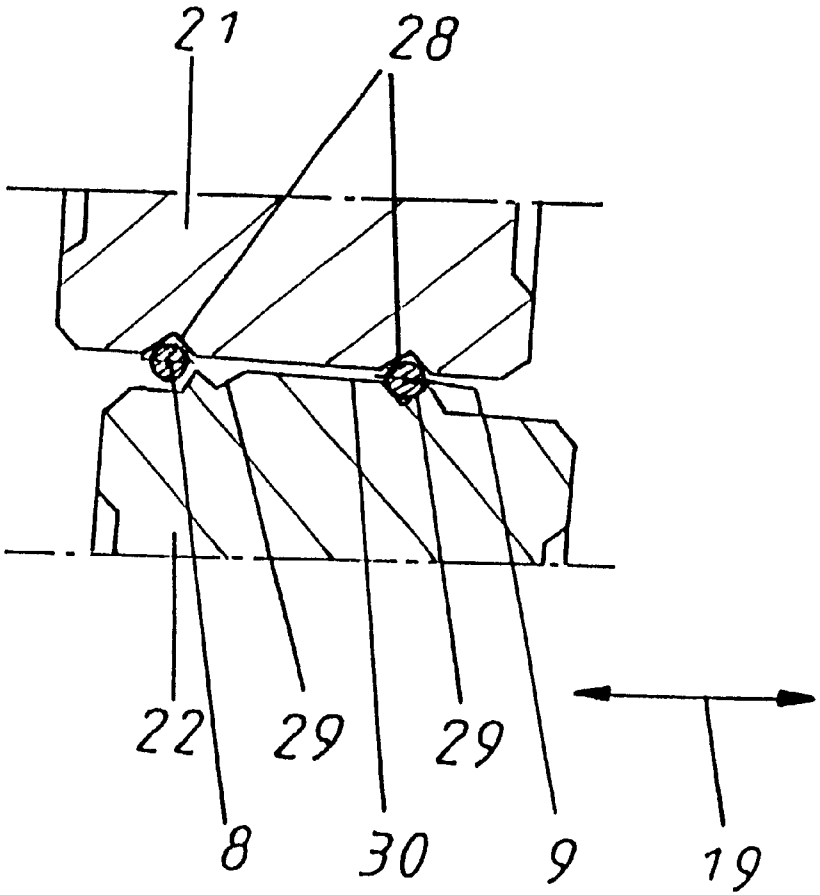
FIG. 6 is a similar view to FIG. 5, with the drive switched over.
Figure 5:
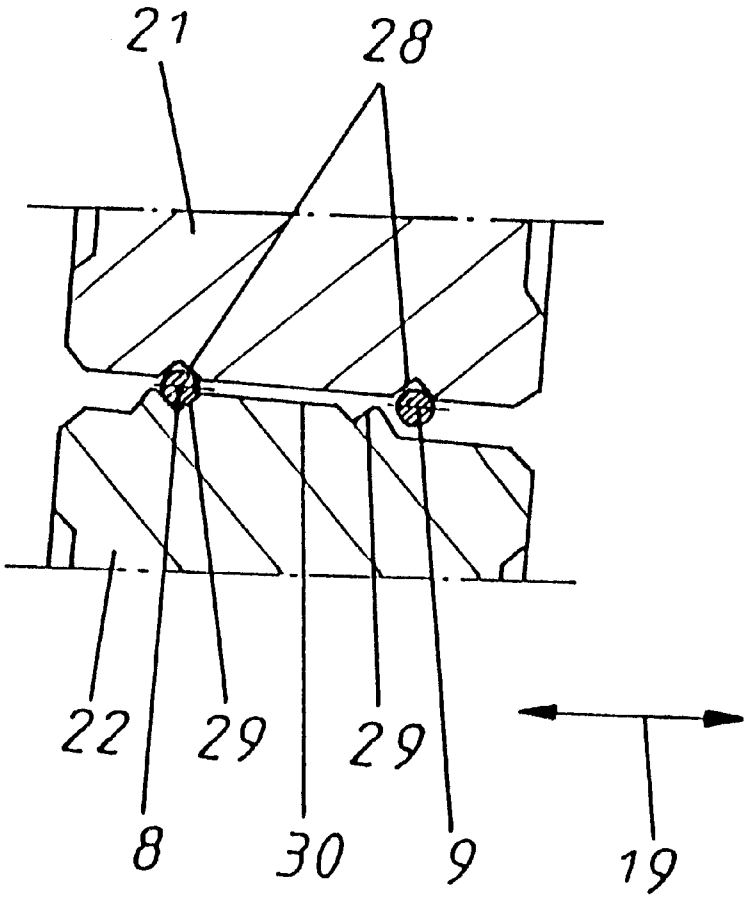
FIG. 5 shows part of the drive of the spring coiling machine.

An alternative drive arrangement for two wires is shown in FIGS. 5 and 6. Each of the rollers 21, 22 has two grooves 28 and 29, respectively, that are spaced apart from one another. The distance between the grooves 28 of the roller 21 is larger than the distance between the grooves 29 of the roller 22. This roller 22 also has a projecting part 30 on which both grooves 29 are formed. The rollers 21, 22 are displaceable in relation to each other in the directions shown by the arrow 19. It is preferable for the upper roller 21 to remain fixed and the lower roller 22 to be displaced, but this is not absolutely necessary.

In the position shown in FIG. 5 the wire 8 is being fed. The left grooves 28, 29 of the rollers 21, 22 are in register. The second wire 9 is sitting in the right groove 28 of the upper roller 21, but is not in contact with the lower roller 22. To switch wires, the two rollers 21, 22 are briefly driven in the opposite direction to the feed direction, to retract the wire 8 from the chamber 5. The rollers 21, 22 are then stopped. Then the lower roller 22 is moved to the right in the direction shown by the arrow 19. The left wire 8 stays in the groove 28 of the upper roller 21 as the lower roller 22 moves away. At the same time, the projecting part 30 runs against the wire 9, forces it slightly upwards, and pushes underneath it. In, the end position shown in FIG. 6, the right grooves 28, 29 are in register. The wire is held between the rollers 21, 22, and is fed, as the wire 8 remains stationary.

If necessary, the roller 21 can be lifted slightly in the direction of the arrow 26 during the sideways motion of the roller 22, and then lowered again.

In a similar manner several wires 8, 9 can be fed by two rollers 21, 22 that are movable in relation to each other.

The spring coiling machine according to the invention is able to change between different wires in rapid succession, thus significantly increasing flexibility.

Figure 7:
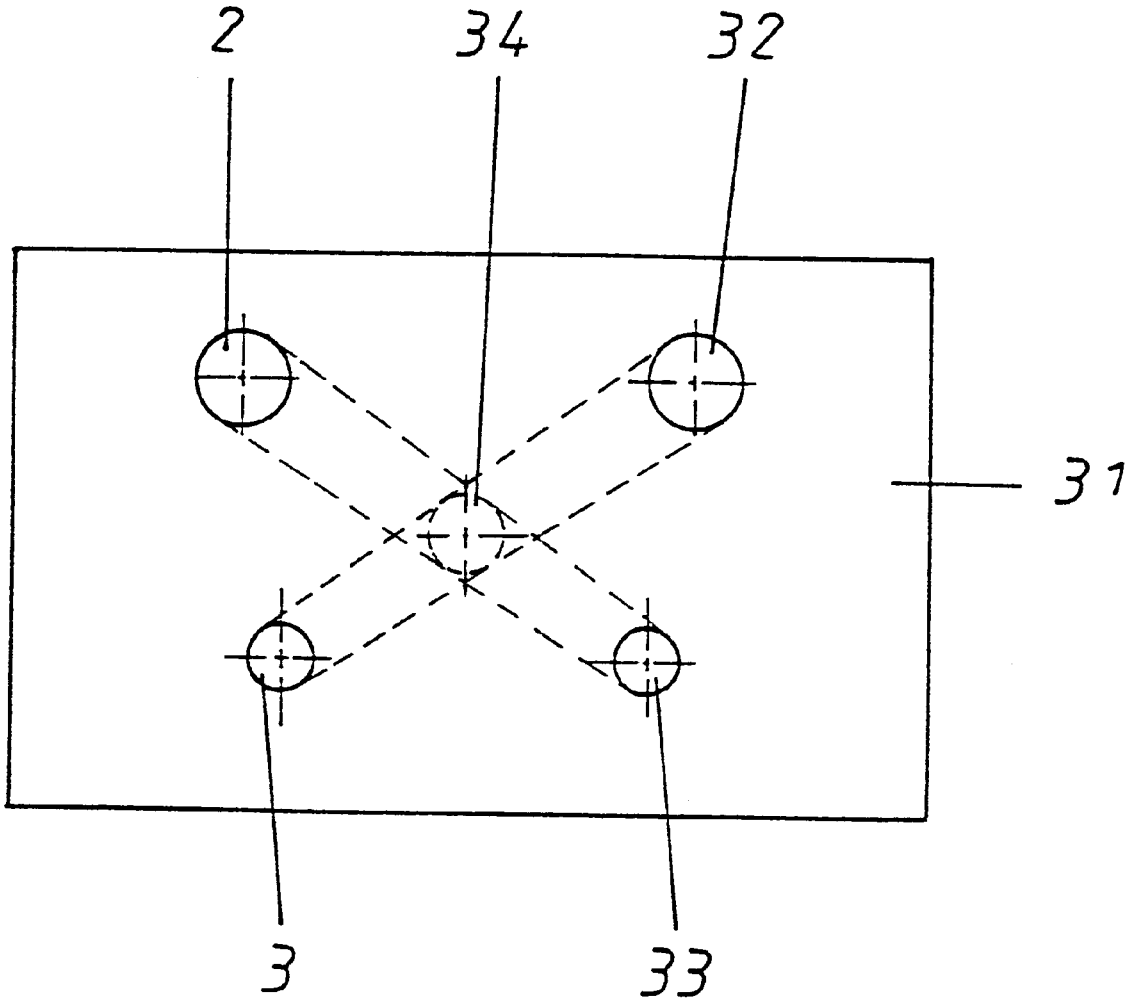
FIG. 7 is a rear view of a four-wire guide block.

All the descriptions and examples which have been given in the context of a two-wire feed also apply to the embodiment shown in FIG. 7, which caters for four wires.

FIG. 7 shows a further guide block 31 in which different-sized bores 2, 3, 32, 33 are arranged for guiding wires of different diameters. (The bores do not necessarily have to be in pairs; they may be all different.)

All bores 2, 3, 32, 33 are aligned with the common outlet opening 34 located approximately at the centre.

If three wires are to be guided, one of the bores 2, 3, 32, 33 is simply left empty.

In the embodiment according to FIGS. 1 to 7, the fork head 35 bounding the chamber 4 to the rear is made large enough for all wires to be accommodated in the chamber 4.

With the second embodiment using roller pairs driven with CNC, the wire in the chamber 4 that is to be severed and no longer fed is retracted until it lies behind the fork head 35 and no longer obstructs the chamber. Another wire can then be introduced into the now-vacant chamber.

Therefore the invention does not presuppose that all the wires which are to be fed must be present in the chamber 4, parallel and side by side, at all times. One or more wires may be retracted from the chamber to leave the chamber clear. Therefore, the machine can be run at higher rates of feed, as the adapter 14 can be dispensed with and the wire can be guided through the guide block 1, 31 with less play.

DRAWING LEGEND

1 guide block
2 bore/groove
3 bore/groove

4 chamber
5 outlet opening
6 angle
7 direction arrow
8 wire
9 wire
10 guide block
11 bore/groove
12 conical tip
13 extension
14 adapter
15 section
16 section
17 section
18 section
19 direction arrow
20 direction arrow
21 roller
22 roller
23 direction arrow
24 direction arrow
25 blade
26 direction arrow
27 direction arrow
28 groove
29 groove
30 projecting part
31 guide block
32 bore
33 bore
34 outlet opening
35 fork head
A drive
B wire guide
C cutter
D collar

What is claimed is:

1. A spring coiling machine having a drive, a wire guide, a cutter mechanism and a single spring coiler mechanism, characterized in that the drive is operative to alternately drive one or other of at least two wires located in the wire guide into the single spring coiler mechanism, said wire guide including a guide block in which there are bores or grooves to receive the wires, which bores or grooves lead into a common chamber with a common outlet opening leading to the single spring coiler mechanism.

2. The spring coiling machine according to claim 1, characterized in that the wire guide has an adapter provided with multiple bores.

3. The spring coiling machine according to claim 2, characterized in that the bores of the adapter on a side facing towards the guide block have a larger diameter which essentially corresponds to that of the outlet opening of the chamber.

4. The spring coiling machine according to claim 3, characterized in that the bores of the adapter are essentially formed in two sections and have a section approximately in the form of a truncated cone and an adjoining, essentially cylindrical section.

5. The spring coiling machine according to claim 2, characterized in that the adapter is rotatable or slidable with respect to the guide block.

6. The spring coiling machine according to claim 1 characterized in that the drive comprises two opposed drive rollers operative to selectively drive either one or other of at least two wires that are located in the wire guide into the coiler mechanism.

7. The spring coiling machine according to claim 6, characterized in that the drive rollers are provided with a number of peripheral grooves which are displaceable in relation to one another in a direction parallel to rotational axes of the drive rollers.

8. The spring coiling machine according to claim 7, characterized in that the distance between the peripheral grooves of one roller is different from the distance between the grooves of the other roller.

9. The spring coiling machine according to claim 7 or 8, characterized in that the distance between the rollers is distinguishable.

10. A method for operating a spring coiling machine having a drive, a wire guide, a cutter mechanism, and a single spring coiler mechanism for switching wire feed between different coil forming wires to said coiler mechanism, which method includes the following steps:

(a) presenting at least two wires to a common dedicated drive;

(b) introducing said wires into a guide block having a single common outlet opening for said wires;

(c) feeding the first wire through the guide block and coiling said first wire into a helical spring;

(d) severing said first wire, and retracting said first wire inside the guide block sufficiently to allow a second wire to be advanced through the outlet opening of the guide block; and (e) feeding the second wire through the guide block to said single coiling mechanism and coiling the second wire into a helical spring within said single coiler mechanism.

11. The method according to claim 10 which comprises driving only one of the wires at any given time.

12. The method according to claim 10 which further comprises adjusting the position of the cutter and coiler to the incoming second wire during retraction of the first wire.

13. The method according to claim 12 wherein the adjustment is made automatically.

14. The method according to anyone of claims 10 to 13 which further comprises adjusting the size of the outlet opening of the wire guide for each of the at least two wires.

15. A spring coiling machine having a drive, a wire guide, a cutter mechanism and a single spring coiler mechanism, characterized in that the drive comprises two opposed drive rollers operative to selectively drive either one or other of at least two wires located between the opposed drive rollers into the single coiler mechanism.

16. The spring coiling machine according to claim 15, characterized in that said drive rollers are provided with a number of peripheral grooves through which said at least two wires are movable.

17. The spring coiling machine according to claim 16, characterized in that said drive rollers are displaceable in relation to one another in a direction parallel to their rotational axis.

18. The spring coiling machine according to claim 17, characterized in that the distance between the grooves of one roller differs from the distance between the grooves of the other roller.

19. The spring coiling machine according to any one of claims 15–18, characterized in that the distance between the rollers is adjustable.

20. A method for operating a spring coiling machine having a drive comprising a pair of opposed drive rollers, a wire guide, a cutter mechanism and a single spring coiler mechanism for switching between different coil forming wires, which method includes the following steps:

(a) presenting at least two wires between the pair of opposed drive rollers;

(b) introducing said wires into a guide block, feeding the first wire of said two wires between the pair of opposed drive rollers and through the guide block and coiling said first wire into a spring within said single coiler mechanism; and (c) severing said first wire, and feeding the second of said two wires between the pair of opposed drive rollers and through the guide block and coiling said second wire into a spring within said single coiler mechanism.

21. The method according to claim 20 which comprises driving only one of the at least two wires at any given time between the pair of opposed drive rollers while the other of the at least two wires remains located between the pair of opposed drive rollers but is not driven by the pair of opposed drive rollers.

22. The method according to claim 20 which further comprises adjusting the position of the coiler to the incoming second wire.

23. The method according to claim 22 wherein the adjustment is made automatically depending upon which of the at least two wires is being supplied to said coiler mechanism.

24. The method according to any one of claims 20 to 23 which further comprises adjusting the size of a delivery opening of the wire guide for each of the at least two wires.

* * * * *